US006006845A

United States Patent [19]

Illerhaus et al.

[11] Patent Number: 6,006,845

[45] Date of Patent: Dec. 28, 1999

[54] ROTARY DRILL BITS FOR DIRECTIONAL DRILLING EMPLOYING TANDEM GAGE PAD ARRANGEMENT WITH REAMING CAPABILITY

[75] Inventors: Roland Illerhaus, The Woodlands, Tex.; Christopher C. Beuershausen, Lafayette, La.; Mark W. Dykstra, Kingwood, Tex.; James A. Norris, Sandy, Utah; Michael P. Ohanian, Slidell, La.; Rudolf C. O. Pessier, Houston, Tex.; John R. Spaar, Covington, La.

[73] Assignee: Baker Hughes Incorporated, Houston, Tex.

[21] Appl. No.: 08/925,284

[22] Filed: Sep. 8, 1997

[51] Int. Cl.[6] ..... E21B 10/26

[52] U.S. Cl. ..... 175/406; 175/393; 175/408

[58] Field of Search ..... 175/393, 406, 175/408

[56] References Cited

U.S. PATENT DOCUMENTS

| | | | |
|---|---|---|---|
| 2,553,701 | 5/1951 | Comstock . | |
| 3,318,400 | 5/1967 | Hildebrandt . | |
| 3,322,218 | 5/1967 | Hildebrandt . | |
| 3,367,430 | 2/1968 | Rowley . | |
| 3,575,247 | 4/1971 | Feenstra . | |
| 3,628,616 | 12/1971 | Neilson | 175/408 X |
| 3,820,611 | 6/1974 | King . | |
| 3,825,083 | 7/1974 | Flarity et al. . | |
| 3,871,488 | 3/1975 | Sabre . | |
| 3,978,933 | 9/1976 | Olson et al. . | |
| 4,073,354 | 2/1978 | Rowley et al. . | |
| 4,221,270 | 9/1980 | Vezirian . | |
| 4,244,432 | 1/1981 | Rowley et al. . | |
| 4,246,977 | 1/1981 | Allen . | |
| 4,385,669 | 5/1983 | Knutsen . | |
| 4,429,755 | 2/1984 | Williamson | 175/393 X |
| 4,545,441 | 10/1985 | Williamson . | |
| 4,602,691 | 7/1986 | Weaver . | |
| 4,673,044 | 6/1987 | Bigelow et al. . | |
| 4,676,324 | 6/1987 | Barr et al. | 175/393 |
| 4,714,120 | 12/1987 | King . | |
| 4,869,330 | 9/1989 | Tibbitts . | |
| 4,941,538 | 7/1990 | King . | |
| 5,004,057 | 4/1991 | Tibbits et al. . | |
| 5,033,559 | 7/1991 | Fischer . | |
| 5,033,560 | 7/1991 | Sawyer et al. . | |
| 5,163,524 | 11/1992 | Newton, Jr. et al. . | |
| 5,415,243 | 5/1995 | Lyon et al. . | |
| 5,467,836 | 11/1995 | Grimes et al. . | |
| 5,558,170 | 9/1996 | Thigpen et al. . | |
| 5,601,151 | 2/1997 | Warren . | |
| 5,651,421 | 7/1997 | Newton et al. | 175/408 X |
| 5,655,612 | 8/1997 | Grimes et al. . | |

FOREIGN PATENT DOCUMENTS

| | | |
|---|---|---|
| 0467580 A1 | 7/1991 | European Pat. Off. . |
| 0522553 A1 | 7/1991 | European Pat. Off. . |
| 2294071 | 4/1996 | United Kingdom . |

*Primary Examiner*—David Bagnell
*Assistant Examiner*—Jong-Suk Lee
*Attorney, Agent, or Firm*—Trask, Britt & Rossa

[57] ABSTRACT

A rotary drag bit being suitable for directional drilling. The bit includes a bit body from which extend radially-oriented blades carrying PDC cutters. The blades extend to primary gage pads, above which secondary gage pads are either longitudinally spaced or rotationally spaced, or both, defining a gap or discontinuity between the primary and secondary gage pads through which drilling fluid from adjacent junk slots may communicate laterally or circumferentially. Longitudinally leading edges of the secondary gage pads carry cutters for smoothing the sidewall of the borehole. The tandem primary and secondary gage pads provide enhanced bit stability and reduced side cutting tendencies. The discontinuities between the primary and secondary gage pads enhance fluid flow from the bit face to the borehole annulus above the bit, promoting formation cuttings removal. The tandem gage arrangement also has utility in conventional bits not designed specifically for directional drilling.

24 Claims, 6 Drawing Sheets

ROTARY DRILL BITS FOR DIRECTIONAL DRILLING EMPLOYING TANDEM GAGE PAD ARRANGEMENT WITH REAMING CAPABILITY

BACKGROUND OF THE INVENTION

1. Field of the Invention

The present invention relates generally to rotary bits for drilling subterranean formations. More specifically, the invention relates to fixed cutter or so-called "drag" bits suitable for directional drilling, wherein tandem gage pads are employed to provide enhanced stability of the bit while drilling both linear and non-linear borehole segments, and leading surfaces of the trailing or secondary gage pads in the tandem arrangement are provided with cutters to remove ledging on the borehole sidewall.

2. State of the Art

It has long been known to design the path of a subterranean borehole to be other than linear in one or more segments, and so-called "directional" drilling has been practiced for many decades. Variations of directional drilling include drilling of a horizontal or highly deviated borehole from a primary, substantially vertical borehole, and drilling of a borehole so as to extend along the plane of a hydrocarbon-producing formation for an extended interval, rather than merely transversely penetrating its relatively small width or depth. Directional drilling, that is to say, varying the path of a borehole from a first direction to a second, may be carried out along a relatively small radius of curvature as short as five to six meters, or over a radius of curvature of many hundreds of meters.

Perhaps the most sophisticated evolution of directional drilling is the practice of so-called navigational or steerable drilling, wherein a drill bit is literally steered to drill one or more linear and non-linear borehole segments as it progresses using the same bottomhole assembly and without tripping the drill string.

Positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottomhole assemblies are known, including those wherein deflection or orientation of the drill string may be altered by selective lateral extension and retraction of one or more contact pads or members against the borehole wall. One such system is the AutoTrak™ system, developed by the INTEQ operating unit of Baker Hughes Incorporated, assignee of the present invention. The bottomhole assembly of the AutoTrak™ system employs a non-rotating sleeve through which a rotating drive shaft extends to drive a rotary bit, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady side force at the bit in a desired direction.

In any case, those skilled in the art have designed rotary bits, and specifically rotary drag, or fixed cutter bits, to facilitate and enhance "steerable" characteristics of bits, as opposed to conventional bit designs wherein departure from a straight, intended path, commonly termed "walk", is to be avoided. Examples of steerable bit designs are disclosed and claimed in U.S. Pat. No. 5,004,057 to Tibbitts, assigned to the assignee of the present invention.

Prevailing opinion for an extended period of time has been that bits employing relatively short gages, in some instances even shorter than gage lengths for conventional bits not intended for steerable applications, facilitate directional drilling. The inventors herein have recently determined that such an approach is erroneous, and that short-gage bits also produce an increased amount of borehole irregularities, such as sidewall ledging, spiraling of the borehole, and rifling of the borehole sidewall. Excessive side cutting tendencies of a bit may lead to ledging of a severity such that downhole tools may actually become stuck when traveling through the borehole.

Elongated gage pads exhibiting little or no side cutting aggressiveness, or the tendency to engage and cut the formation, may be beneficial for directional or steerable bits, since they would tend to prevent sudden, large, lateral displacements of the bit, which displacements may result in the aforementioned so-called "ledging" of the borehole wall. However, a simplistic elongated gage pad design approach exhibits shortcomings, as continuous, elongated gage pads extending down the side of the bit body may result in the trapping of formation cuttings in the elongated junk slots defined at the gage of the bit between adjacent gage pads, particularly if a given junk slot is provided with less than optimum hydraulic flow from its associated fluid passage on the face of the bit. Such clogging of only a single junk slot of a bit has been demonstrated to cause premature bit balling in soft, plastic formations. Moreover, providing lateral stabilization for the bit only at the circumferentially-spaced locations of gage pads comprising extensions of blades on the bit face may not be satisfactory in all circumstances. Finally, enhanced stabilization using elongated gage pads may not necessarily preclude all ledging of the borehole sidewall.

Thus, there is a need for a drill bit which provides good directional stability as well as steerability, precludes lateral bit displacement, enhances formation cuttings removal from the bit, and maintains borehole quality.

BRIEF SUMMARY OF THE INVENTION

The present invention comprises a rotary drag bit, preferably equipped with polycrystalline diamond compact (PDC) cutters on blades extending above and radially to the side beyond the bit face, wherein the bit includes tandem, non-aggressive gage pads in the form of primary or longitudinally leading gage pads which may be substantially contiguous with the blades, and secondary or longitudinally trailing gage pads which are at least either longitudinally or rotationally discontinuous with the primary gage pads. Such an arrangement reduces any tendency toward undesirable side cutting by the bit, reducing ledging of the borehole sidewall.

The discontinuous tandem gage pads of the present invention provide the aforementioned benefits associated with conventional elongated gage pads, but provide a gap or aperture between circumferentially adjacent junk slots in the case of longitudinally discontinuous pads so that hydraulic flow may be shared between laterally-adjacent junk slots.

In the case of rotationally-offset secondary gage pads, there is provided a set of rotationally-offset, secondary junk slots above (as the bit is oriented during drilling) the primary junk slots, each of which secondary junk slots communicates with two circumferentially adjacent primary junk slots extending from the bit face, the hydraulic and cuttings flow from each primary junk slot being divided between two secondary junk slots. Thus, a relatively low-flow junk slot is not completely isolated, and excess or greater flows in its two laterally-adjacent junk slots may be contributed in a balancing effect, thus alleviating a tendency toward clogging of any particular junk slot.

In yet another aspect of the invention, the use of circumferentially-spaced, secondary gage pads rotationally offset from the primary gage pads provides superior bit stabilization by providing lateral support for the bit at twice as many circumferential locations as if only elongated primary gage pads or circumferentially-aligned primary and secondary gage pads were employed. Thus, bit stability is enhanced during both linear and non-linear drilling, and any tendency toward undesirable side cutting by the bit is reduced. Moreover, each primary junk slot communicates with two secondary junk slots, promoting fluid flow away from the bit face and reducing any clogging tendency.

In still another aspect of the invention, the secondary gage pads employed in the inventive bit are equipped with cutters on their longitudinally leading edges or surfaces at locations extending radially outwardly only substantially to the radially outer bearing surfaces of the secondary gage pads. Such cutters may also lie longitudinally above the leading edges or surfaces of a pad, but again do not extend beyond the radially outer bearing surface. Such cutters may comprise natural diamonds, thermally stable PDCs, or conventional PDCs comprised of a diamond table supported on a tungsten carbide substrate. The presence of the secondary gage pad cutters provides a reaming capability to the bit so that borehole sidewall irregularities created as the bit drills ahead are smoothed by the passage of the secondary gage pads. Thus, any minor ledging created as a result of bit lateral vibrations or by frequent flexing of the bottomhole assembly driving the bit due to inconsistent application of weight on bit can be removed, improving borehole quality.

Using the tandem gage according to the present invention, a better quality borehole and borehole wall surface in terms of roundness, longitudinal continuity and smoothness is created. Such borehole conditions allow for smoother transfer of weight from the surface of the earth through the drill string to the bit, as well as better tool face control, which is critical for monitoring and following a design borehole path by the actual borehole as drilled.

DETAILED DESCRIPTION OF THE INVENTION

Figure 1:
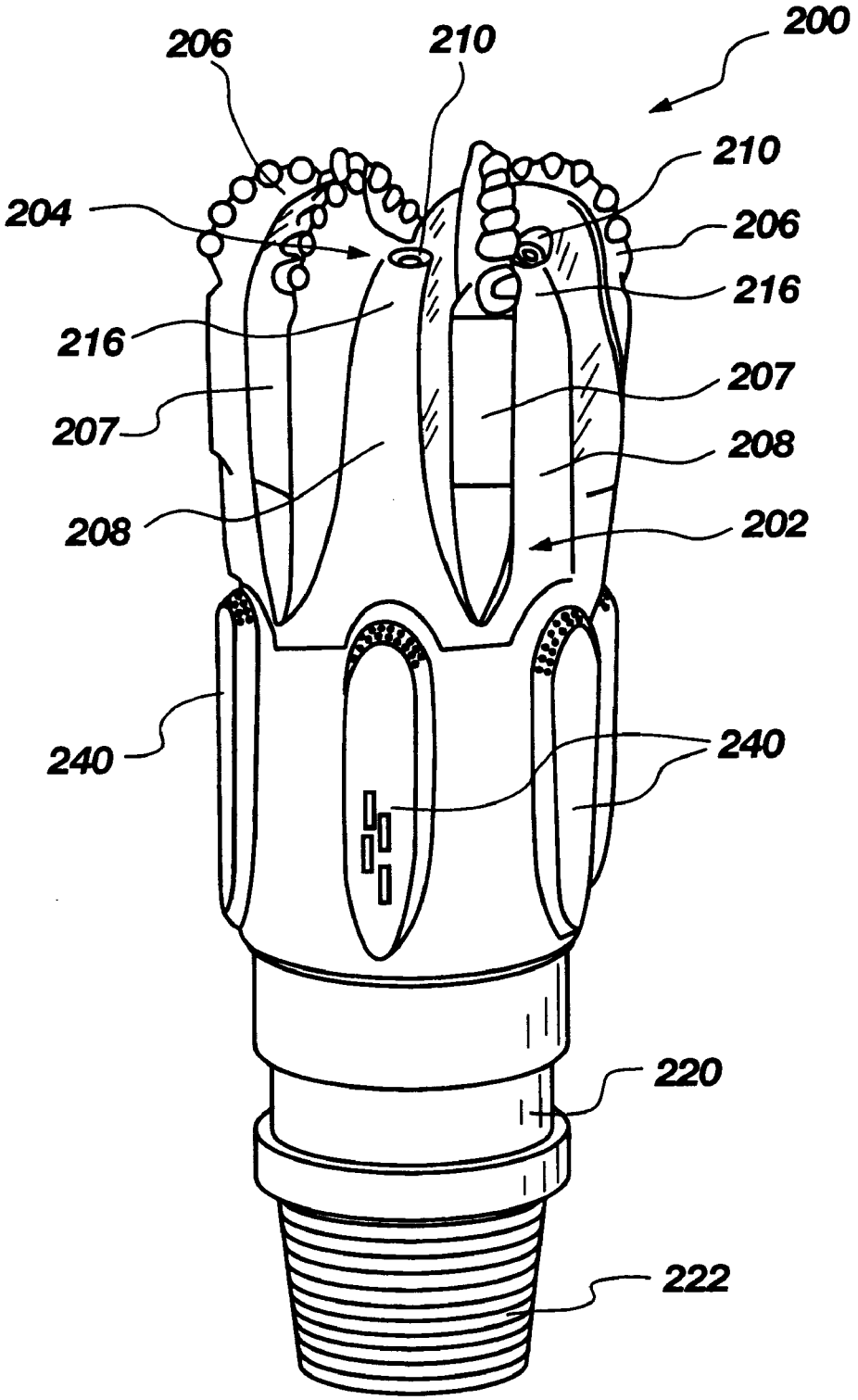
FIG. 1 comprises a side perspective view of a PDC-equipped rotary drag bit according to the present invention.
Figure 2:
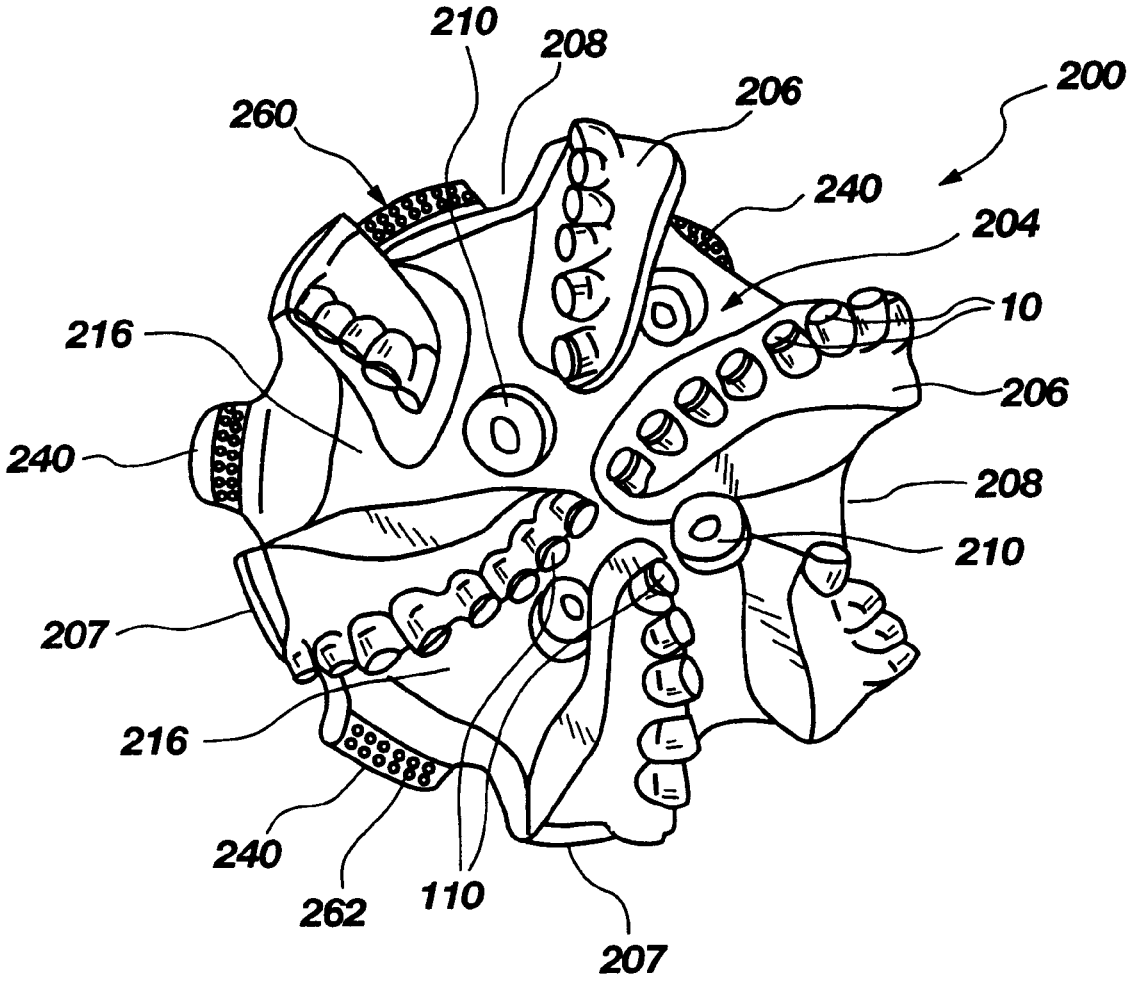
FIG. 2 comprises a face view of the bit of FIG. 1.
Figure 3:
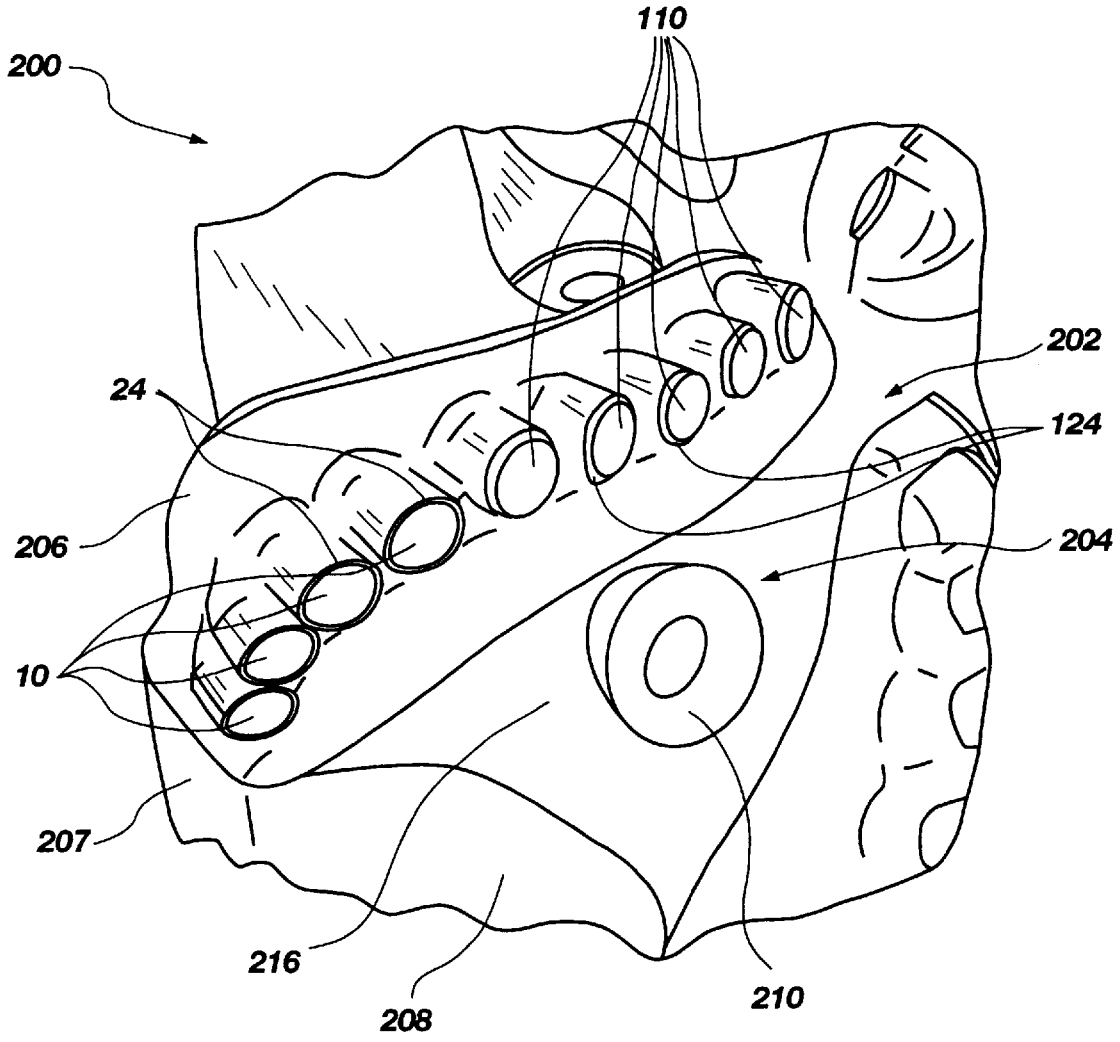
FIG. 3 comprises an enlarged, oblique face view of a single blade of the bit of FIG. 1.

FIGS. 1 through 5 depict an exemplary rotary drag bit 200 according to the invention. Bit 200 includes a body 202 having a face 204 and including a plurality (in this instance, six) of generally radially oriented blades 206 extending above the bit face 204 to primary gage pads 207. Primary junk slots 208 lie between longitudinal extensions of adjacent blades 206, which comprise primary gage pads 207 in the illustrated embodiment. A plurality of nozzles 210 provides drilling fluid from plenum 212 within the bit body 202 and received through passages 214 to the bit face 204. Formation cuttings generated during a drilling operation are transported across bit face 204 through fluid courses 216 communicating with respective primary junk slots 208. Secondary gage pads 240 are rotationally and substantially longitudinally offset from primary gage pads 207, and provide additional stability for bit 200 when drilling both linear and non-linear borehole segments. Shank 220 includes a threaded pin connection 222 as known in the art, although other connection types may be employed.

Figure 4:
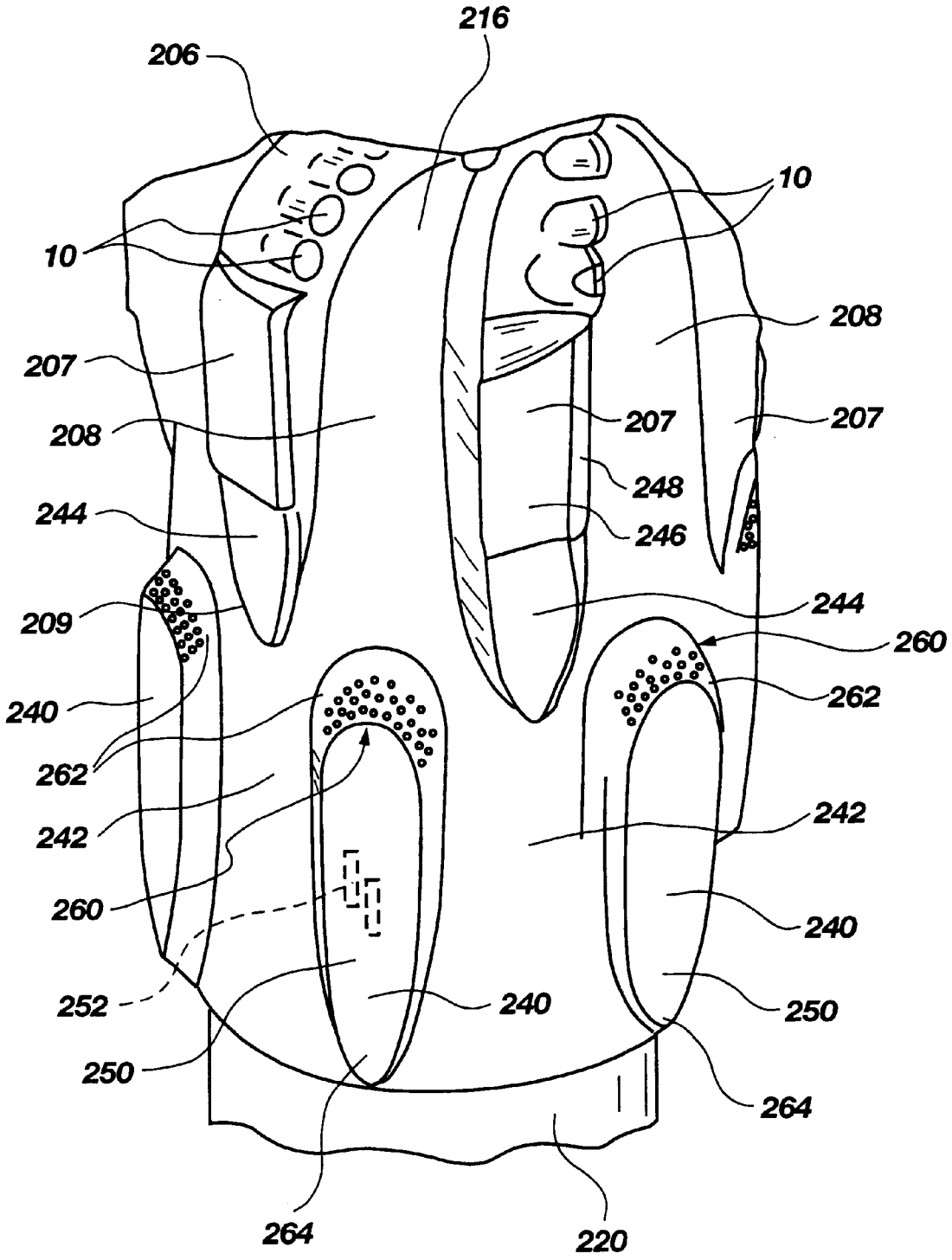
FIG. 4 is an enlarged perspective view of the side of the bit of FIG. 1, showing the configurations and relative locations and orientations of tandem primary gage pads (blade extensions) and secondary gage pads according to the invention.

Primary gage pads 207 define primary junk slots 208 therebetween, while secondary gage pads 240 define secondary junk slots 242 therebetween, each primary junk slot 208 feeding two secondary junk slots 242 with formation cuttings-laden drilling fluid received from fluid courses 216 on the bit face. As shown, the trailing, radially outer surfaces 244 of primary gage pads 207 are scalloped or recessed to some extent, the major, radially outer bearing surfaces 246 of the primary gage pads 207 are devoid of exposed cutters and the rotationally leading edges 248 thereof are rounded or smoothed to substantially eliminate any side cutting tendencies above (in normal drilling orientation) radially outermost cutters 10 on blades 206. Similarly, the radially outer bearing surfaces 250 of secondary gage pads 240 are devoid of exposed cutters, and preferably comprise wear-resistant surfaces such as tungsten carbide, diamond grit-filled tungsten carbide, a ceramic, or other abrasion-resistant material as known in the art. The outer surfaces 250 may also comprise discs, bricks or other inserts of wear-resistant material (see 252 in FIG. 4) bonded to the outer surface of the pads, or bonded into a surrounding powdered WC matrix material with a solidified liquid metal binder, as known in the art. The outer bearing surfaces 246, 250 of respective primary and secondary gage pads 207 and 240 may be rounded at a radius of curvature, taken from the centerline or longitudinal axis of the bit, substantially the same as (slightly smaller than) the gage diameter of the bit, if desired. Further, the secondary gage pads 240 may be sized to define a smaller diameter than the primary gage pads 207, and measurably smaller than the nominal or gage diameter of the bit 200. As shown in FIGS. 1 and 4, there may be a slight longitudinal overlap between primary gage pads 207 and secondary gage pads 240, although this is not required (see FIG. 6) and the tandem gage pads 207, 240 may be entirely longitudinally discontinuous. It is preferable that the trailing ends 209 of primary gage pads 207 be tapered or streamlined as shown, in order to enhance fluid flow therepast and eliminate areas where hydraulic flow and entrained formation cuttings may stagnate. It is also preferable that secondary gage pads 240 (as shown) be at least somewhat streamlined at both leading edges or surfaces 262 and at their trailing ends 264 for enhancement of fluid flow therepast.

Secondary gage pads 240 carry cutters 260 on their longitudinally leading edges, which in the illustrated embodiment comprise arcuate surfaces 262. As shown, cutters 260 comprise exposed, three-per-carat natural diamonds, although thermally stable PDCs may also be employed in the same manner. The distribution of cutters 260 over arcuate leading surfaces 262 provides both a longitudinal and rotational cutting capability for reaming the sidewall of the borehole after passage of the bit blades 206 and primary gage pads 207 to substantially remove any irregularities in and on the sidewall, such as the aforementioned ledges. Thus, the bottomhole assembly following bit 200 is presented with a smoother, more regular borehole configuration.

Figure 6:
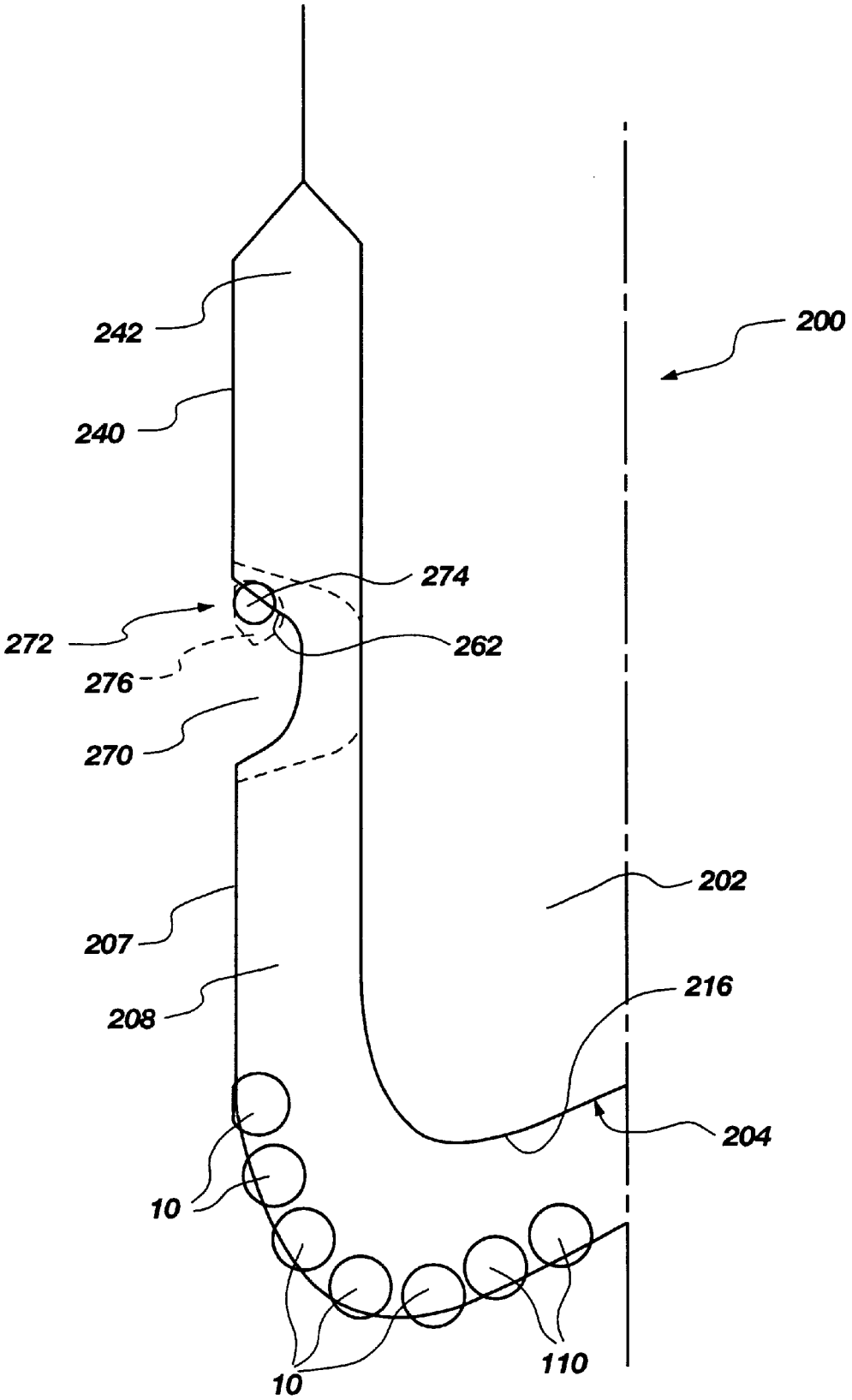
FIG. 6 is a schematic side view of a longitudinally-discontinuous tandem gage pad arrangement according to the invention, depicting the use of PDC cutters on the secondary gage pad leading edge.

As shown in FIG. 6, the bit 200 of the present invention may alternatively comprise circumferentially aligned but longitudinally discontinuous gage pads 207 and 240, with a notch or bottleneck 270 located therebetween. In such a configuration, primary junk slots 208 are rotationally aligned with secondary junk slots 242, and mutual fluid communication between laterally adjacent junk slots (and indeed, about the entire lateral periphery or circumference of bit 200) is through notches or bottlenecks 270. The radial recess depth of notches or bottlenecks 270 may be less than the radial height of the gage pads 207 and 240, or may extend to the bottoms of the junk slots defined between the gage pads, as shown in broken lines. In FIG. 6, the cutters employed on the leading surface 262 of secondary gage pad 240 comprise PDC cutters 272, which may exhibit disc-shaped cutting faces 274, or may be configured with flat or linear cutting edges as shown in broken lines 276. It should also be understood that more than one type of cutter 260 may be employed on a secondary gage pad 240, and that different types of cutters 260 may be employed on different secondary gage pads 240.

Figure 5:
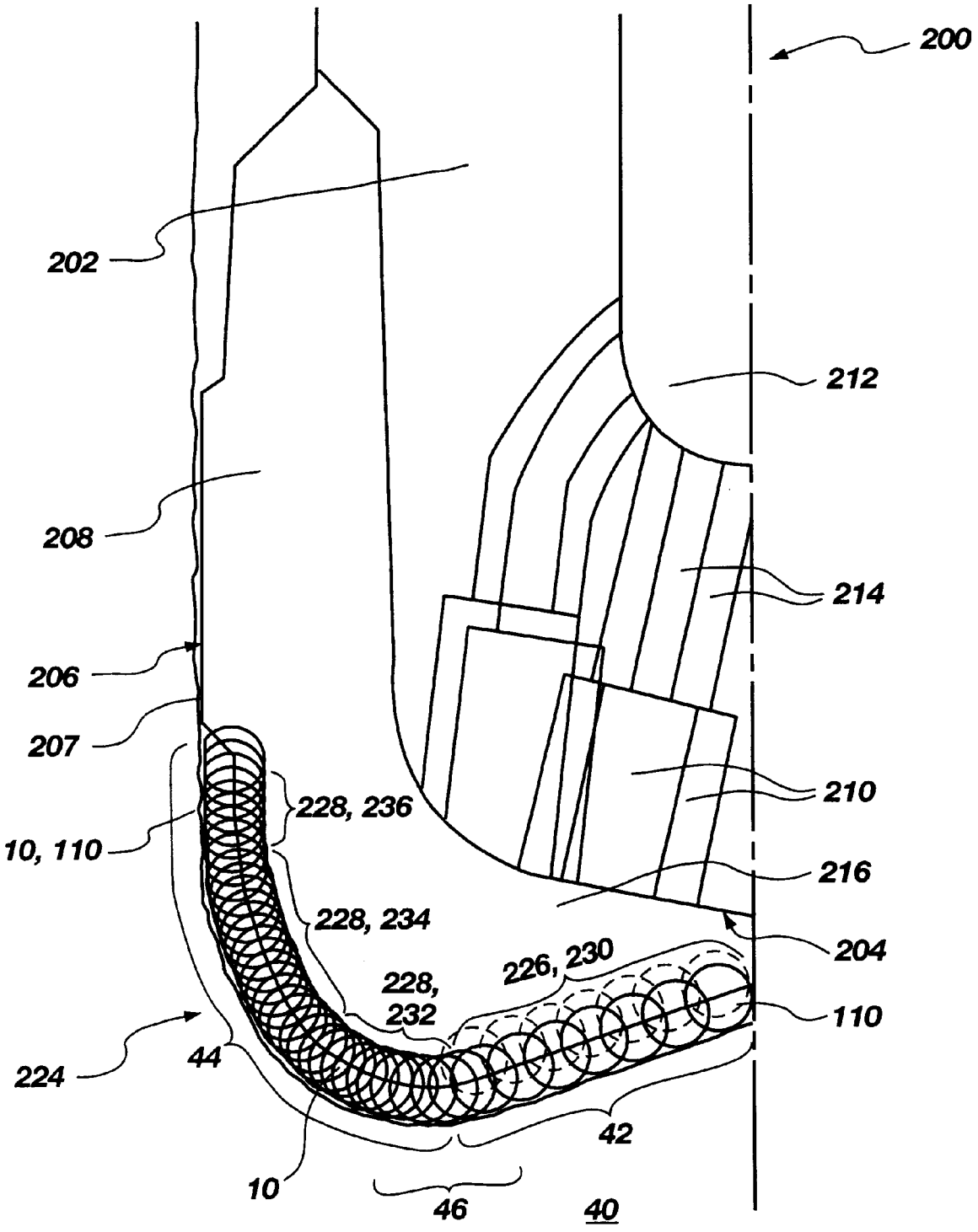
FIG. 5 comprises a quarter-sectional side schematic of a bit having a profile such as that of FIG. 1, with the cutter locations rotated to a single radius extending from the bit centerline to the gage to disclose various cutter chamfer sizes and angles, and cutter backrake angles, which may be employed with the inventive bit.

To complete the description of the bit of FIGS. 1 through 5, although the specific structure is not required to be employed as part of the invention herein, the profile 224 of the bit face 204 as defined by blades 206 is illustrated in FIG. 5, wherein bit 200 is shown adjacent a subterranean rock formation 40 at the bottom of the well bore. Bit 200 is, as disclosed, believed to be particularly suitable for directional drilling, wherein both linear and non-linear borehole segments are drilled by the same bit. First region 226 and second region 228 on profile 224 face adjacent rock zones 42 and 44 of formation 40 and respectively carry large chamfer cutters 110 and small chamfer cutters 10. First region 226 may be said to comprise the cone 230 of the bit profile 224 as illustrated, whereas second region 228 may be said to comprise the nose 232 and flank 234 and extend to shoulder 236 of profile 224, terminating at primary gage pad 207.

In a currently preferred embodiment of the invention, large chamfer cutters 110 may comprise cutters having PDC tables in excess of 0.070 inch thickness, and preferably about 0.080 to 0.090 inch thickness, with chamfers 124 of about a 0.030 to 0.060 inch width, looking at and perpendicular to the cutting face, and oriented at a 45° angle to the cutter axis. The cutters themselves, as disposed in region 226, are backraked at 20° to the bit profile at each respective cutter location, thus providing chamfers 124 with a 65° backrake. Cutters 10, on the other hand, disposed in region 228, may comprise conventionally-chamfered cutters having about a 0.030 inch PDC table thickness, and a 0.010 inch chamfer width looking at and perpendicular to the cutting face, with chamfers 24 oriented at a 45° angle to the cutter axis. Cutters 10 are themselves backraked at 15° on nose 232 (providing a 60° chamfer backrake), while cutter backrake is further reduced to 10° at the flank 234, shoulder 236 and on the primary gage pads 207 of bit 200 (resulting in a 55° chamfer backrake). The PDC cutters 10 on primary gage pads 207 include preformed flats thereon oriented parallel to the longitudinal axis of the bit 200, as known in the art. In steerable applications requiring greater durability at the shoulder 236, large chamfer cutters 110 may optionally be employed, but oriented at a 10° cutter backrake. Further, the chamfer angle of cutters 110 in each of regions 226 and 236 may be other than 45°. For example, 70° chamfer angles may be employed with chamfer widths (looking vertically at the cutting face of the cutter) in the range of about 0.035 to 0.045 inch, cutters 110 being disposed at appropriate backrakes to achieve the desired chamfer rake angles in the respective regions.

A boundary region, rather than a sharp boundary, may exist between first and second regions 226 and 228. For example, rock zone 46 bridging the adjacent edges of rock zones 42 and 42 of formation 40 may comprise an area wherein demands on cutters and the strength of the formation are always in transition due to bit dynamics. Alternatively, the rock zone 46 may initiate the presence of a third region on the bit profile wherein a third size of cutter chamfer is desirable. In any case, the annular area of profile 224 opposing zone 46 may be populated with cutters of both types (i.e., width and chamfer angle) and employing backrakes respectively employed in region 226 and those of region 228, or cutters with chamfer sizes, angles and cutter backrakes intermediate those of the cutters in regions 226 and 228 may be employed.

Further, it will be understood and appreciated by those of ordinary skill in the art that the tandem gage pad configuration of the invention has utility in conventional bits as well as for bits designed specifically for steerability, and is therefore not so limited.

In the rotationally-offset secondary gage pad variation of the invention, it is further believed that the additional contact points afforded between the bit and the formation may reduce the tendency of a bit to incur damage under "whirl", or backward precession about the borehole, such phenomenon being well known in the art. By providing additional, more closely circumferentially-spaced points of lateral contact between the bit and the borehole sidewall, the distance a bit may travel laterally before making contact with the sidewall is reduced, in turn reducing severity of any impact.

While the present invention has been described in light of the illustrated embodiment, those of ordinary skill in the art will understand and appreciate it is not so limited, and many additions, deletions and modifications may be effected to the invention as illustrated without departing from the scope of the invention as hereinafter claimed. For example, primary and secondary gage pads may be straight or curved, and may be oriented at an angle to the longitudinal axis of the bit so as to define a series of helical segments about the lateral periphery thereof.

What is claimed is:

1. A rotary drag bit for drilling a subterranean formation, comprising:

a bit body having a longitudinal axis and extending radially outward therefrom toward a gage, the bit body including a face to be oriented toward the subterranean formation during drilling and carrying cutting structure for cutting the subterranean formation and defining a borehole diameter therethrough; and a first plurality of circumferentially-spaced gage pads disposed about a periphery of the bit body and extending radially therefrom and longitudinally away from the bit face, at least some of the gage pads having at least one radially outer bearing surface and at least one discrete longitudinally leading surface extending from the at least one radially outer bearing surface and defining a portion of the gage pad, the at least one discrete longitudinally leading surface carrying cutters thereon and generally within the portion of the gage pad defined by the discrete longitudinally leading surface.

2. The rotary drag bit of claim 1, wherein the cutters carried by the longitudinally leading surfaces of the at least some of the gage pads do not protrude substantially radially beyond the radially outer surfaces of the gage pads.

3. The rotary drag bit of claim 1, wherein the cutters comprise material selected from the group consisting of natural diamonds, thermally stable PDCs, and PDCs.

4. The rotary drag bit of claim 3, wherein at least one gage pad carries cutters comprised of differing materials.

5. The rotary drag bit of claim 1, wherein the leading surfaces of the at least some of the gage pads include areas extending to sides of a gage pads, and at least some of the cutters are located on side areas.

6. The rotary drag bit of claim 5, wherein the leading surfaces of the at least some of the gage pads are arcuate, and wherein the cutters comprise natural diamonds secured to the leading surfaces.

7. The rotary drag bit of claim 1, further including a second plurality of circumferentially-spaced gage pads disposed about a periphery of the bit body and extending radially therefrom, the second plurality of gage pads located substantially between the bit face and the first plurality of gage pads and extending longitudinally therebetween, the first plurality of gage pads being discontinuous with the second plurality of gage pads.

8. The rotary drag bit of claim 7, wherein the gage pads of the first and second pluralities of gage pads are substantially circumferentially aligned, and are discontinuous due to the presence of longitudinal discontinuities between longitudinally adjacent gage pads of each of the first and second pluralities of gage pads.

9. The rotary drag bit of claim 8, wherein the longitudinal discontinuities comprise an annular recess extending substantially about the periphery of the bit body.

10. The rotary drag bit of claim 8, wherein the longitudinal discontinuities extend radially inwardly to the bit body.

11. The rotary drag bit of claim 10, wherein the longitudinal discontinuities comprise an annular recess extending substantially about the periphery of the bit body.

12. The rotary drag bit of claim 7, wherein the gage pads of the first and second pluralities of gage pads are substantially mutually rotationally offset, and each of the first plurality of gage pads are substantially circumferentially discontinuous with each of the second plurality of gage pads.

13. The rotary drag bit of claim 12, wherein each of the first plurality of gage pads are longitudinally discontinuous with each of the second plurality of gage pads.

14. The rotary drag bit of claim 7, wherein each of the first plurality of gage pads include radially outer surfaces defining radially outer extents of the gage pads, and the cutters carried by the longitudinally leading surfaces of the at least some of the gage pads do not protrude substantially radially beyond the radially outer surfaces of the gage pads.

15. The rotary drag bit of claim 7, wherein the cutters are selected from the cutter types comprising natural diamonds, thermally stable PDCs, and PDCs.

16. The rotary drag bit of claim 15, wherein at least one gage pad carries more than one cutter type.

17. The rotary drag bit of claim 7, wherein the leading surfaces of the at least some of the gage pads include areas extending to sides of the gage pads, and at least some of the cutters are located on side areas.

18. The rotary drag bit of claim 17, wherein the leading surfaces of the at least some of the gage pads are arcuate, and wherein the cutters comprise natural diamonds secured to the leading surfaces.

19. The rotary drag bit of claim 7, wherein the cutting structure comprises a plurality of blades disposed over and radially beyond the bit face, the blades each carrying at least one cutter thereon.

20. The rotary drag bit of claim 19, wherein each of the second plurality of gage pads comprise extensions of the blades.

21. The rotary drag bit of claim 7, wherein each of the first plurality of gage pads defines a smaller diameter than the gage pads of the second plurality of gage pads.

22. The rotary drag bit of claim 7, wherein the first plurality of gage pads and the second plurality of gage pads are substantially non-aggressive on radially oriented surfaces thereof.

23. The rotary drag bit of claim 7, wherein the first and second pluralities of gage pads comprise the same number of pads.

24. The rotary drag bit of claim 1, wherein each of the first plurality of gage pads is substantially non-aggressive on a radially oriented surface thereof.

* * * * *

UNITED STATES PATENT AND TRADEMARK OFFICE

CERTIFICATE OF CORRECTION

PATENT NO. : 6,006,845
DATED : December 28, 1999
INVENTOR(S) : Roland Illerhaus et al.

It is certified that error appears in the above-identified patent and that said Letters Patent is hereby corrected as shown below:

Column 4,
Line 43, after "outer" insert -- bearing --

Column 6,
Line 9, change "236" to -- 228 --
Line 19, change "42 and 42" to -- 42 and 44 --

Column 7,
Line 6, after "of" insert -- each of the at least some of -- and change "pad" to -- pads --
Line 8, after "of" insert -- each of the least some of --
Line 9, change "pad" to -- pads --
Line 14, after "outer" insert -- bearing -- and after "of" insert -- at least some of --
Lines 22 and 30, change "a" to -- the --

Column 8,
Lines 4 and 7, change "are" to -- is --
Lines 10 and 14, after "outer" insert -- bearing --
Line 10, change "include" to -- includes --
Lines 11 and 14, after "of the" insert -- first plurality of --
Line 33, change "comprise" to -- comprises --

Signed and Sealed this

Thirteenth Day of April, 2004

JON W. DUDAS
*Acting Director of the United States Patent and Trademark Office*